US007974847B2

(12) United States Patent
Kjoerling et al.

(10) Patent No.: US 7,974,847 B2
(45) Date of Patent: Jul. 5, 2011

(54) ADVANCED METHODS FOR INTERPOLATION AND PARAMETER SIGNALLING

(75) Inventors: Kristofer Kjoerling, Stockholm (SE); Heiko Purnhagen, Stockholm (SE); Jonas Engdegard, Stockholm (SE); Jonas Roeden, Stockholm (SE)

(73) Assignee: Coding Technologies AB, Stockholm (SE)

( * ) Notice: Subject to any disclaimer, the term of this patent is extended or adjusted under 35 U.S.C. 154(b) by 1372 days.

(21) Appl. No.: 11/286,199

(22) Filed: Nov. 22, 2005

(65) Prior Publication Data

US 2006/0136229 A1 Jun. 22, 2006

Related U.S. Application Data

(63) Continuation of application No. PCT/EP2005/011665, filed on Oct. 31, 2005.

(30) Foreign Application Priority Data

Nov. 2, 2004 (SE) ..... 0402651

(51) Int. Cl.
*G10L 19/00* (2006.01)

(52) U.S. Cl. ..... 704/500; 704/501; 704/502; 704/503; 704/504; 704/E19.005; 704/E19.01

(58) Field of Classification Search ..... 381/24; 704/500, 501, 503, 504, E19.005, E19.01, 704/502

See application file for complete search history.

(56) References Cited

U.S. PATENT DOCUMENTS

| | | | | |
|---|---|---|---|---|
| 4,953,214 | A * | 8/1990 | Takeguchi et al. | 704/230 |
| 5,265,219 | A | 11/1993 | Gerson et al. | |
| 5,808,574 | A * | 9/1998 | Johnson et al. | 341/110 |
| 5,903,866 | A * | 5/1999 | Shoham | 704/265 |
| 5,956,674 | A * | 9/1999 | Smyth et al. | 704/200.1 |
| 5,974,380 | A * | 10/1999 | Smyth et al. | 704/229 |
| 6,424,822 | B1 | 7/2002 | Mekuria et al. | |
| 6,708,145 | B1 * | 3/2004 | Liljeryd et al. | 704/200.1 |
| 6,999,593 | B2 * | 2/2006 | Rui et al. | 381/92 |
| 7,328,161 | B2 * | 2/2008 | Oh | 704/500 |
| 7,548,853 | B2 * | 6/2009 | Shmunk et al. | 704/219 |
| 7,630,902 | B2 * | 12/2009 | You | 704/500 |
| 2004/0138886 | A1 * | 7/2004 | Absar et al. | 704/240 |
| 2005/0137858 | A1 * | 6/2005 | Heikkinen et al. | 704/205 |
| 2005/0187759 | A1 * | 8/2005 | Malah et al. | 704/200 |

(Continued)

FOREIGN PATENT DOCUMENTS

TW 543307 7/2003

(Continued)

OTHER PUBLICATIONS

Fielder et al. "Introduction to Dolby Digital Plus, an Enhancement to the Dolby Digital Coding System" Oct. 2004.*

(Continued)

*Primary Examiner* — Richemond Dorvil
*Assistant Examiner* — Greg Borsetti
(74) *Attorney, Agent, or Firm* — Michael A. Glenn; Glenn Patent Group

(57) ABSTRACT

A parameter calculator calculates lower resolution parametric information and interpolation information. On a decoder-side, an upmixer is used for generating the output channels. The upmixer uses high resolution parametric information generated by a parameter interpolator using the low resolution parametric information and decoder-side derived interpolation information or encoder-generated interpolation information for selecting one of a plurality of different interpolation characteristics.

31 Claims, 16 Drawing Sheets

U.S. PATENT DOCUMENTS

| | | | | |
|---|---|---|---|---|
| 2006/0074642 | A1* | 4/2006 | You | 704/222 |
| 2007/0016427 | A1* | 1/2007 | Thumpudi et al. | 704/500 |
| 2007/0063877 | A1* | 3/2007 | Shmunk et al. | 341/50 |
| 2007/0140499 | A1* | 6/2007 | Davis | 381/23 |
| 2008/0031463 | A1* | 2/2008 | Davis | 381/17 |

FOREIGN PATENT DOCUMENTS

| | | |
|---|---|---|
| TW | 565826 | 12/2003 |
| TW | 200531554 | 9/2005 |
| WO | WO 03/007656 | 1/2003 |

OTHER PUBLICATIONS

Herre. "From Joint Stereo to Spatial Audio Coding—Recent Progress and Standardization" Oct. 2004.*
Herre. "From Joint Stereo to Spatial Audio Coding—Recent Progress and Standarization" Oct. 5-8, 2004.*
Schuijers et al. "Low complexity parametric stereo coding" May 8-11, 2004.*
Breebaart et al. "Parametric Coding of Stereo Audio" Jan. 2005.*
Freeland et al. "Efficient HRTF Interpolation in 3D Moving Sound" 2002.*
Engdegard et al. "Synthetic Ambience in Parametric Stereo Coding" May 8-11, 2004.*
Ehret et al. "aacPlus, only a low-bitrate codec?" Oct. 28-31, 2004.*
Faller et al. "Binaural Cue Coding Applied to Stereo and Multi-Channel Audio Compression" 2002.*
Breebaart et al. "High-quality parametric spatial audio coding at low bitrates" May 8-11, 2004.*
Faller. "Parametric Coding of Spatial Audio" Jul. 2004.*
Breebaart."Modeling Binaural Signal Detection" 2001.*
Purnhagen. "Parameter Estimation and Tracking for Time-Varying Sinusoids" 2002.*
Herre et al. "Spatial Audio Coding: Next-generation efficient and compatible coding of multi-channel audio" Oct. 2004.*
Faller. "Coding of Spatial Audio Compatible with Different Playback Formats" Oct. 2004.*
Herre et al. "MP3 Surround: Efficient and Compatible Coding of Multi-Channel Audio" May 2004.*
Herre et al. "The Reference Model Architecture for MPEG Spatial Audio Coding" May 2005.*
Myburg. "Design of a Scalable Parametric Audio Coder" Jan. 2004.*
Purnhagen. "Low Complexity Parametric Stereo Coding in MPEG-4" Oct. 2004.*
Baumgarte et al. "Audio Coder Enhancement using Scalable Binaural Cue Coding with Equalized Mixing" 2004.*
Vafin et al. "Improved Modeling of Audio Signals by Modifying Transient Locations" 2001.*
Schuijers et al. "Advances in Parametric Coding for High-Quality Audio" 2003.*
Parallel Taiwanese Patent Application Office Action dated Feb. 27, 2009, with English Translation (7 pages total).

* cited by examiner

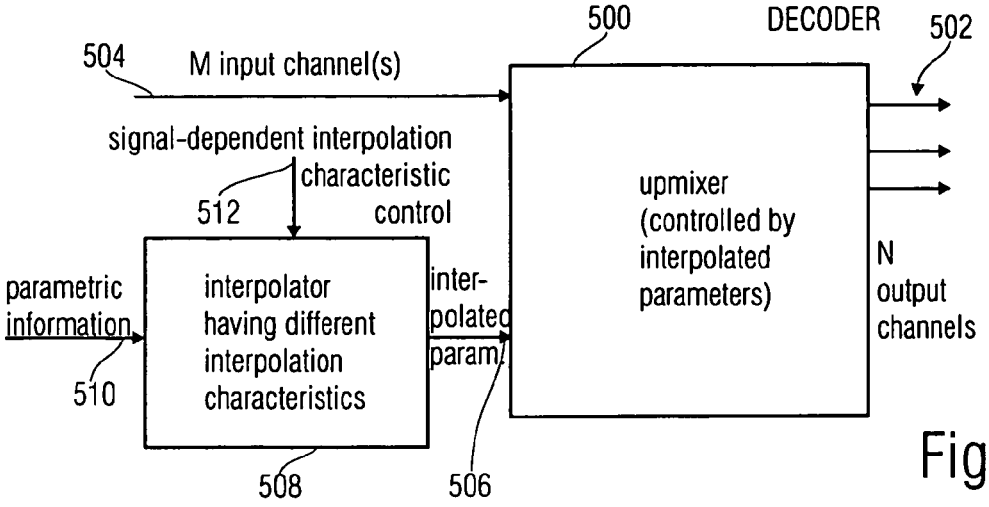

Fig. 5a

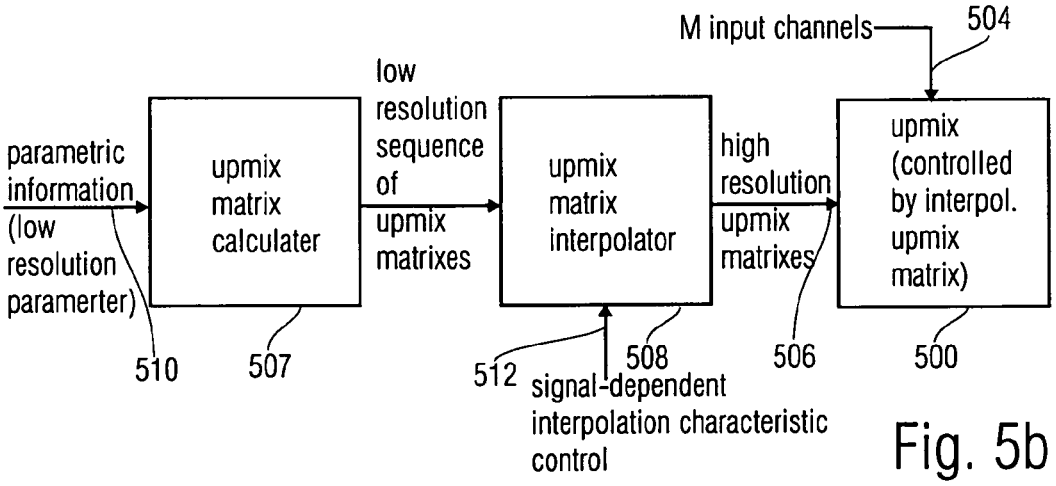

Fig. 5b $$\begin{bmatrix} L \\ R \\ L_s \\ R_s \\ C \end{bmatrix} = \begin{bmatrix} \alpha_{11} & \alpha_{12} \\ \alpha_{21} & \alpha_{22} \\ \alpha_{31} & \alpha_{32} \\ \alpha_{41} & \alpha_{42} \\ \alpha_{51} & \alpha_{52} \end{bmatrix} * \begin{bmatrix} B1 \\ B2 \end{bmatrix} + \begin{matrix} f(\alpha_{61}, B1, B2) \\ f(\alpha_{62}, B1, B2) \end{matrix}$$

upmix matrix coefficients: $\alpha_{11}, \ldots, \alpha_{52}, \alpha_{61}, \alpha_{62}$ $L, R, L_s, R_s, C$: reconstructed output channels B1, B2: transmitted base channels

Fig. 5c (decoder side)

(encoder side)

(encoder side)

OUTPUT SIGNAL
- parameter 1 or 2 (optionally in encoded form)
- parameter difference (optionally in encoded form)
- optionally select information

ADVANCED METHODS FOR INTERPOLATION AND PARAMETER SIGNALLING

CROSS-REFERENCE TO RELATED APPLICATION

This application is a continuation of copending International Application No. PCT/EP05/011665, filed Oct. 31, 2005, which designated the United States, and is incorporated herein by reference in its entirety.

BACKGROUND OF THE INVENTION

1. Field of the Invention

The present invention relates to audio source coding systems but the same methods could also be applied in many other technical fields.

2. Description of Related Art

Recent development in audio coding has made available the ability to recreate a multi-channel representation of an audio signal based on a stereo (or mono) signal and corresponding control data. These methods differ substantially from older matrix based solution such as Dolby Prologic, since additional control data is transmitted to control the re-creation, also referred to as up-mix, of the surround channels based on the transmitted mono or stereo channels.

Hence, the parametric multi-channel audio decoders reconstruct N channels based on M transmitted channels, where N>M, and the additional control data. The additional control data represents a significant lower data rate than transmitting all N channels, making the coding very efficient while at the same time ensuring compatibility with both M channel devices and N channel devices.

These parametric surround coding methods usually comprise a parameterisation of the surround signal based on IID (Inter channel Intensity Difference) and ICC (Inter Channel Coherence). These parameters, commonly referred to as "spatial parameters" describe power ratios and correlation between channel pairs in the up-mix process. Further parameters also used in prior art comprise prediction parameters used to predict intermediate or output channels during the up-mix procedure.

The spatial parameters can be extracted in several ways. One beneficial method as known in prior art, is to device several encoding modules that take two original input signals and produces an output signal, being a downmix of the two input signals, and the corresponding spatial parameters required to recreate an accurate replica of the two original signals based on the mono downmix and the spatial parameters. Another commonly used encoding module requires three input signals, and produces two output signals and the corresponding spatial parameters.

These modules can be connected in what is commonly referred to as a tree structure, where the output of one module is input to another module.

The above mentioned parameters need to be coded efficiently, in order to get the lowest bitrate over-head. At the same time, an optimum choice between frequency resolution and time resolution needs to be made. The present invention teaches several ways to optimize the trade-off between time and frequency resolution of the spatial parameters, as well as introducing novel methods for signalling, and controlling interpolation of the parameters.

SUMMARY OF THE INVENTION

It is an object of the present invention to provide an improved concept of parametric encoding especially suitable for stereo of generally multi-channel encoding or decoding.

In accordance with a first aspect, the present invention provides a decoder having: an upmixer for generating N output channels using one or more input channels and interpolated high resolution parametric information; a parameter interpolator for generating the interpolated high resolution parametric information based on low resolution parametric information, the parameter interpolator being adapted to adaptively use one of a plurality of different interpolation characteristics for interpolating the low resolution parametric information in response to a control signal; and a control signal provider for providing the control signal, wherein the control signal depends on the one or more input channels, the low resolution parametric information or signalling information available at the decoder.

In accordance with a second aspect, the present invention provides an encoder for generating a parametric information derived from an original signal having N input channels, having: a parameter calculator for calculating low resolution parametric information describing one or more relations between two or more of the N input channels; and an interpolation information calculator for generating high resolution interpolation information based on at least two of the N input channels, wherein the interpolation information calculator is operative to generate the interpolation information such that the interpolation information is usable for interpolating the low resolution parametric information to obtain a high resolution parametric information.

In accordance with a third aspect, the present invention provides a decoding method having: generating N output channels using one or more input channels and interpolated high resolution parametric information; generating the interpolated high resolution parametric information based on low resolution parametric information by adaptively using one of a plurality of different interpolation characteristics for interpolating the low resolution parametric information in response to a control signal; and providing the control signal, the control signal depending on the one or more input channels, the low resolution parametric information or signalling information available at a decoder.

In accordance with a fourth aspect, the present invention provides a method of generating a parametric information derived from an original signal having N input channels, having: calculating low resolution parametric information describing one or more relations between two or more of the N input channels; and generating high resolution interpolation information based on at least two of the N input channels, wherein the interpolation information calculator is operative to generate the interpolation information such that the interpolation information is usable for interpolating the low resolution parametric information to obtain a high resolution parametric information.

In accordance with a fifth aspect, the present invention provides parametric information derived from an original signal having N original channels, having: a low resolution parametric information describing one or more relations between two or more original channels; and high resolution interpolation information, the high resolution interpolation information being usable for interpolating the low resolution parametric information to obtain a high resolution parametric information.

The present invention relates to the problem of achieving high quality spatial audio reconstruction while keeping the transmitted data at a minimum. This is achieved by a providing several solutions for representing and signalling of spatial audio cues and especially improving the time resolution.

The present invention comprises the following features:

Estimation and signalling of interpolation curves;

Estimation of parameters in relation to other parameters

Implicit interpolation rules in the decoder.

An interpolation of a parameter can also be performed, i.e., be moved or "recalculated" to the up-mix matrix domain. All parameters are recalculated to an upmix matrix, and this matrix can be interpolated rather than the parameters. The effect is the same as interpolating before the calculation of the upmix matrix or the upmixing coefficients applied to the transmitted base channels(s). Interpolating of upmix coefficients instead of transmitted parameters is preferable, since this is more implementation efficient. Psycho acoustically, interpolation in both domains does not make any difference.

BRIEF DESCRIPTION OF THE DRAWINGS

The present invention will now be described by way of illustrative examples, not limiting the scope or spirit of the invention, with reference to the accompanying drawings, in which:

FIG. 5*a* illustrates a preferred decoder embodiment of the present invention;

FIG. 5*b* illustrates a further preferred decoder embodiment of the present invention;

FIG. 5*c* illustrates an example for upmixing coefficients which can be used for building an upmix matrix;

DESCRIPTION OF PREFERRED EMBODIMENTS

The below-described embodiments are merely illustrative for the principles of the present invention for ADVANCED METHODS FOR INTERPOLATION AND PARAMETER SIGNALLING. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Implicit Interpolation Rules in Decoder.

It is known that signalling of an adaptive time/frequency grid improves quality and coding efficiency. It is also known that the time frequency grid should be dependant on signal characteristics and that usually transients trigger a time border before the transient. Interpolation is often applied in time direction to prevent too sudden changes in extracted and decoded parameterisation, which otherwise could emerge as sound artifacts. The present invention teaches that knowledge about how the adaptive time/frequency grid is created dependant on signal characteristics can be used to create implicit rules on how interpolation should be applied when interpolating one point in time to the next. E.g. in the case of a stationary signal which does not have any transients linear interpolation could be used to create a smooth transition from one set of parameters to the next. Another example of the present invention is that in case of an transient the interpolation should hold the previous value up until right prior to the transient and at that point in time change to the, for the transient, signalled value.

Figure 1:
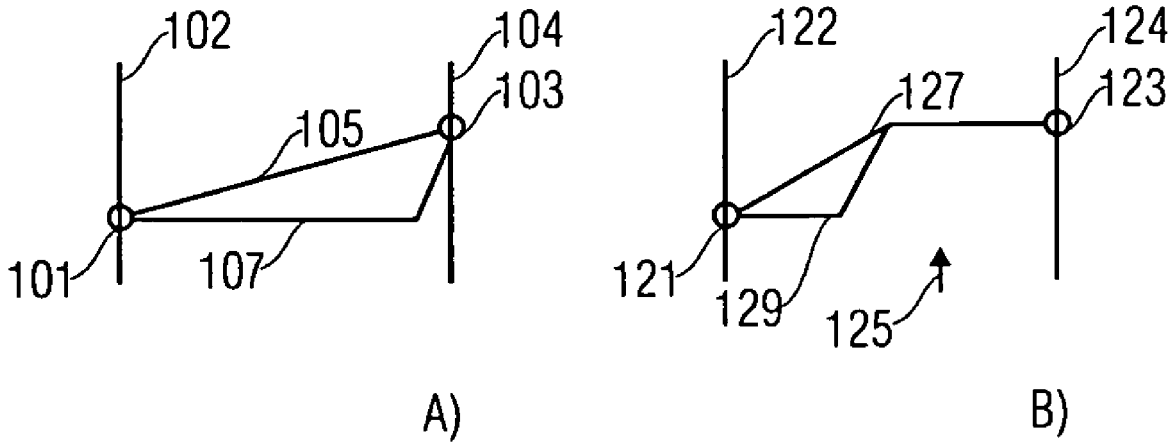
FIG. 1 illustrates different interpolation schemes.

Two examples of interpolation is illustrated in FIG. 1, where FIG. 1A shows interpolation between two values, 101 and 103 at respective position 102 and 104 as either as linear interpolation 105 or transient interpolation 107. FIG. 1B shows how an additional transient position 125 can be used to influence the interpolation between the two values, 121 and 123 at respective position 122 and 124. Linear interpolation is illustrated by 127 and 129 illustrates a transient interpolation where previous parameter value 121 is kept until right before the transient. When designing the transient interpolation 129, in reference to the transient position 125, special care should be taken to accommodate psycho-acoustic relevant time constants.

Interpolation Curves.

For signals with extremely complex time structure as e.g. several independent applause signals the present invention teaches that signalling an interpolation curve can improve the complex time domain structure. The signalling of an interpolation curve can e.g. be a lookup table with a table of applicable curves where the selection at the encoder side can be based on a calculation of the mean square error for different interpolation curves. The interpolation curve can also be a difference signal, coded relative to a curve given by a predetermined interpolation rule e.g. linear interpolation. Hence all implicit interpolation mentioned above can be combined with an difference interpolation curve to achieve a finer time resolution. The interpolation coding can be done in one single band covering the entire frequency range or in a multi frequency band resolution. It is also evident that the frequency resolution of the interpolation curve does not have to coincide but can be mapped to the frequency resolution of the parameters that should be interpolated.

The present invention also teaches that there can be advantages in normalizing the interpolation curve to decrease the lookup table size or limit the swing within which the interpolation curve is allowed to operate.

Figure 2:
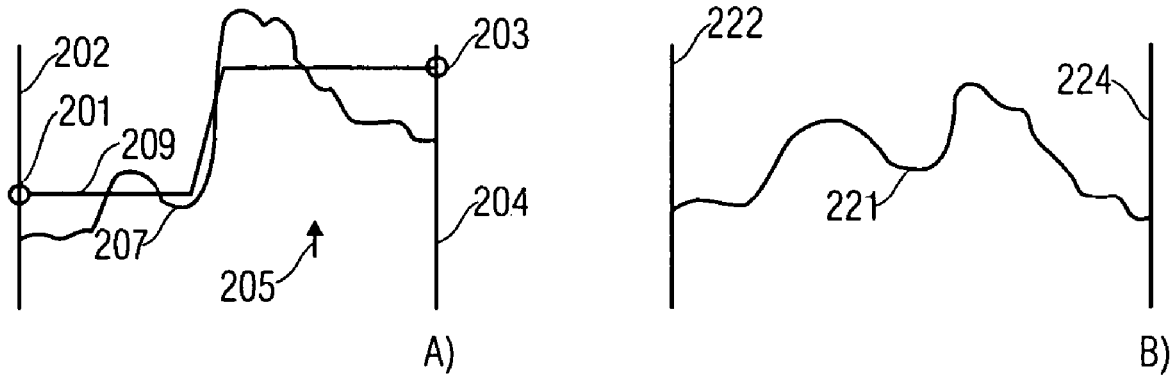
FIG. 2 illustrates the how differential interpolation curves can be used.

An example of an interpolation curve is illustrated in FIG. 2A, where an implicit transient interpolation 209, is based on the interpolation from the values 201 and 203 at respective positions 202 and 204, and also taking the transient position 205 into account. The interpolation curve 207, which has a finer temporal resolution than the implicit transient interpolation 209 can be differentially coded and normalized with respect to the implicit transient interpolation curve 209. Hence, the normalized curve represents the difference between the implicit transient interpolation curve available at the decoder, and the high temporal resolution curve estimated on the encoder. This is illustrated by 221 in FIG. 2B. The positions 222 and 224 are the same as 201 and 203, respectively. The interpolation curve 221 can e.g. be coded as a look-up table or the values constituting the interpolation curve can be delta coded in time and redundancy coded with e.g. Huffman codebooks. At the decoder side the implicit interpolation curve 209 is combined with the interpolation curve 221 in order to retain the high temporal resolution. Furthermore, the interpolation curves 221 can be used when a higher temporal resolution is required and omitted when additional temporal resolution is not required. This gives the possibility to minimize average bitrate, while still retaining high temporal resolution when required.

Extreme Case, One Freq Band, High Time Resolution Envelope Follower

In the previous section interpolation curves were outlined that can be used for frequency selective parameters. However, the present invention also teaches that when deciding on time and frequency resolution for signals with extremely complex time structure as e.g. several independent applause signals, it can be sufficient to let the parameters represent just one single time envelope for all frequency bands. This implementation of the interpolation curves as taught by the present invention can then be seen as a special case of the previously outlined interpolation curves. The high temporal resolution of the interpolation curve enables the parameter extraction to resolve the complex temporal structure.

Figure 3:
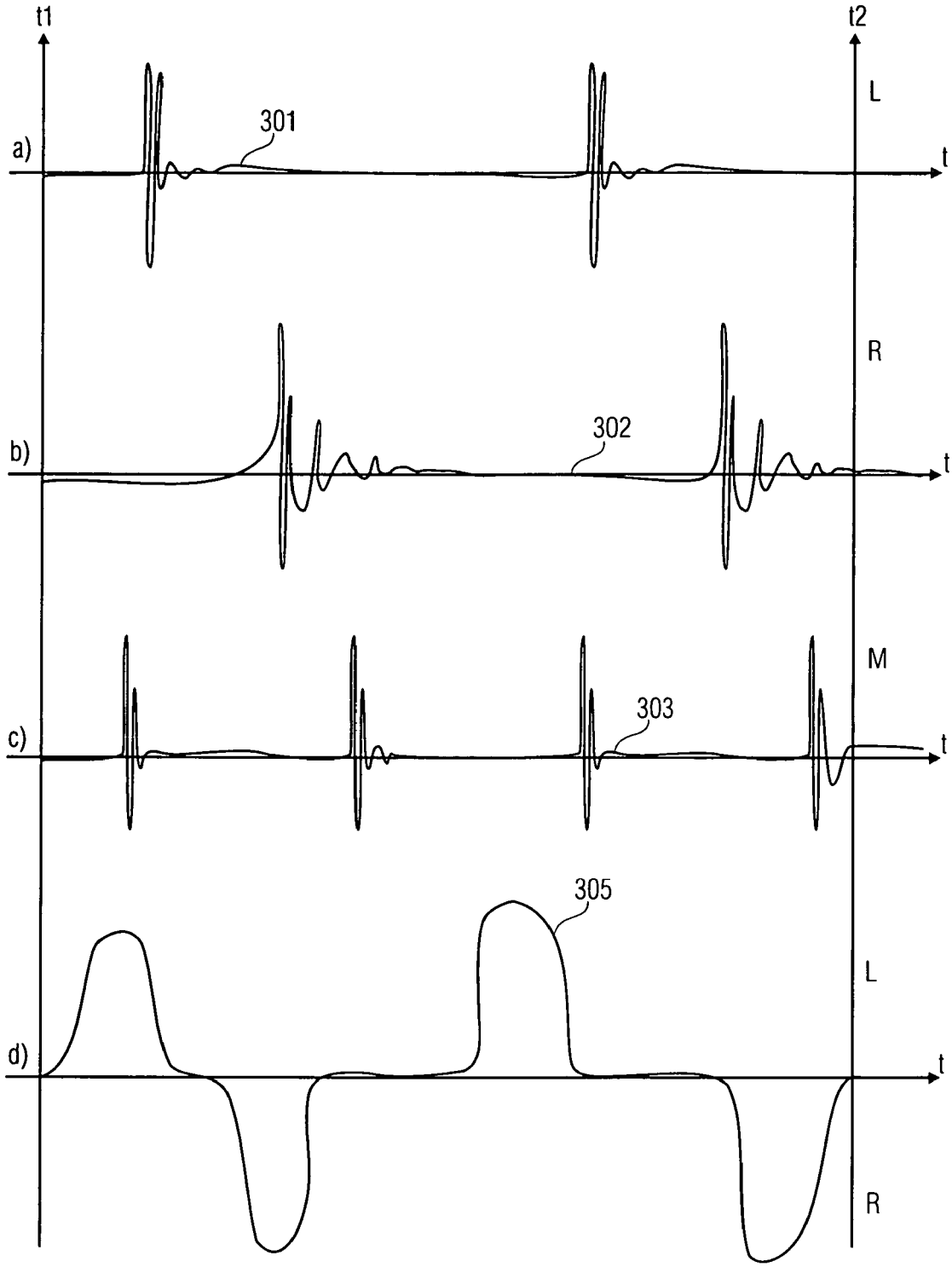
FIG. 3 illustrates an interpolation example according to the present invention.

In FIG. 3. an alternative embodiment of the present invention on interpolation curves is outlined. In FIG. 3*a* a time domain presentation of the left channel is displayed 301. The time signals are displayed from time-points $t_1$ and $t_2$. In FIG. 3*b* the right channel is displayed 302. Here it is evident that the transients are located in different channels at different points in time. In FIG. 3*c* the mono downmix of the left and right channel is displayed 303.

In FIG. 3*d* the pan-values for an arbitrary frequency band is displayed 304 along with an interpolation curve 305. A positive value corresponds to panning to the left and a negative value panning to the right. Since the transients appear within a short time frame the control values for different frequency bands are only estimated once in time-point $t_1$ and once in time-point $t_2$. These are linearly interpolated for every frequency band and for a specific frequency band they are represented by curve 304. From this curve it is evident that the up-mix will not place the transients in the right spatial position. However, when applying the interpolation curve 305 (that is a broad band interpolation curve for all frequency bands) the transients are moved to the correct spatial position.

Thus, a preferred embodiment of the invention is a decoder that does linear interpolation or (simple) implicitly signalled interpolation for a number of frequency bands, and the high-time resolution interpolation curve is used for all frequency bands, to re-distribute the transients. Stated in other words, this decoder firstly performs the normal linear or implicitly signalled interpolation to obtain "first step" interpolated values, which are then weighted (such as multiplied) using the high-time resolution interpolation curve for obtaining "second step" interpolated values, in which the transients are redistributed compared to the first step interpolated values.

Using Symmetries in Multi Channel Tree Structure

Figure 4A:
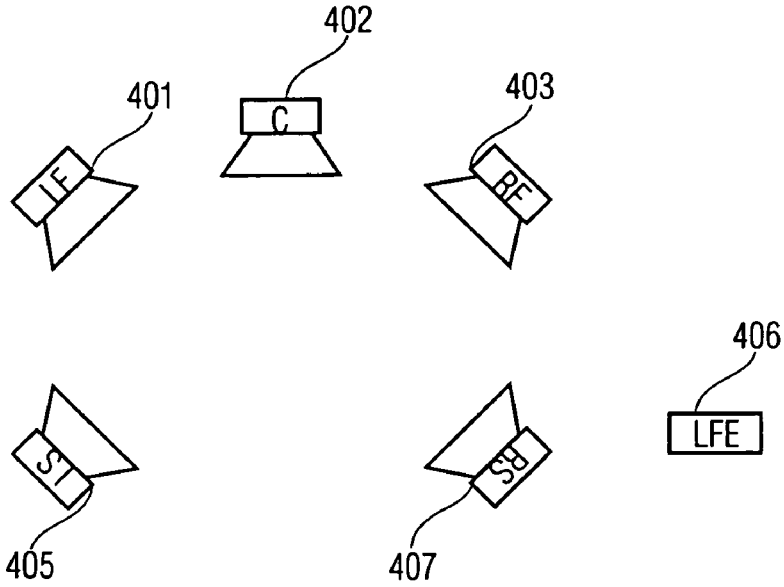
FIG. 4 illustrates a multi-channel configuration and the parameter coding.
Figure 4B:
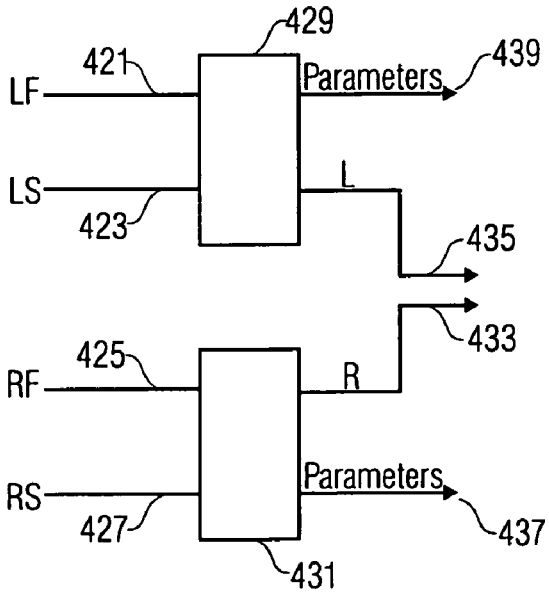

When coding multi channel sound several 2 channel spatial parameter boxes can be connected in a tree structure to form a coding chain for multi channel sound where each box operates on a 2-channel input and gives a mono signal and spatial parameters as output. In this tree structure, which can be configured in several different ways, there usually arise symmetries. E.g. as shown in FIG. 4A for a 4 channel surround signal with 4 speakers (Left Front (LF) 401, Right Front (RF) 403, Left Surround (LS) 405, Right Surround (RS) 407 preferably also a center 402 and also a LFE (low frequency enhancement) speaker) a tree system as shown in FIG. 4B can for example connect LF 421, LS 423 and RF 425, RS 427. When coding spatial parameters for these two 2 channel spatial encoders, 429 and 431 which output audio signals 435, 433 and parameters 439 and 437, it is commonly know that parameters can be delta coded in time or frequency. Delta coding in frequency is commonly forced now and then to prevent error propagation in a real-time system. This invention teaches that the spatial parameters from one box 439 in the tree structure can be delta coded towards parameters from another box 437, which can prevent error propagation and using the symmetries in the tree structure a data rate reduction can be achieved. This is advantageous in the example above using 4 speakers if a sound event happens in the front speakers both the parameters for LF, LS and RF, RS will react similarly and hence instead of coding the same event twice it is more efficient to code it once and delta code the difference.

Further Description of Preferred Embodiments of the Present Invention

Figure 8:
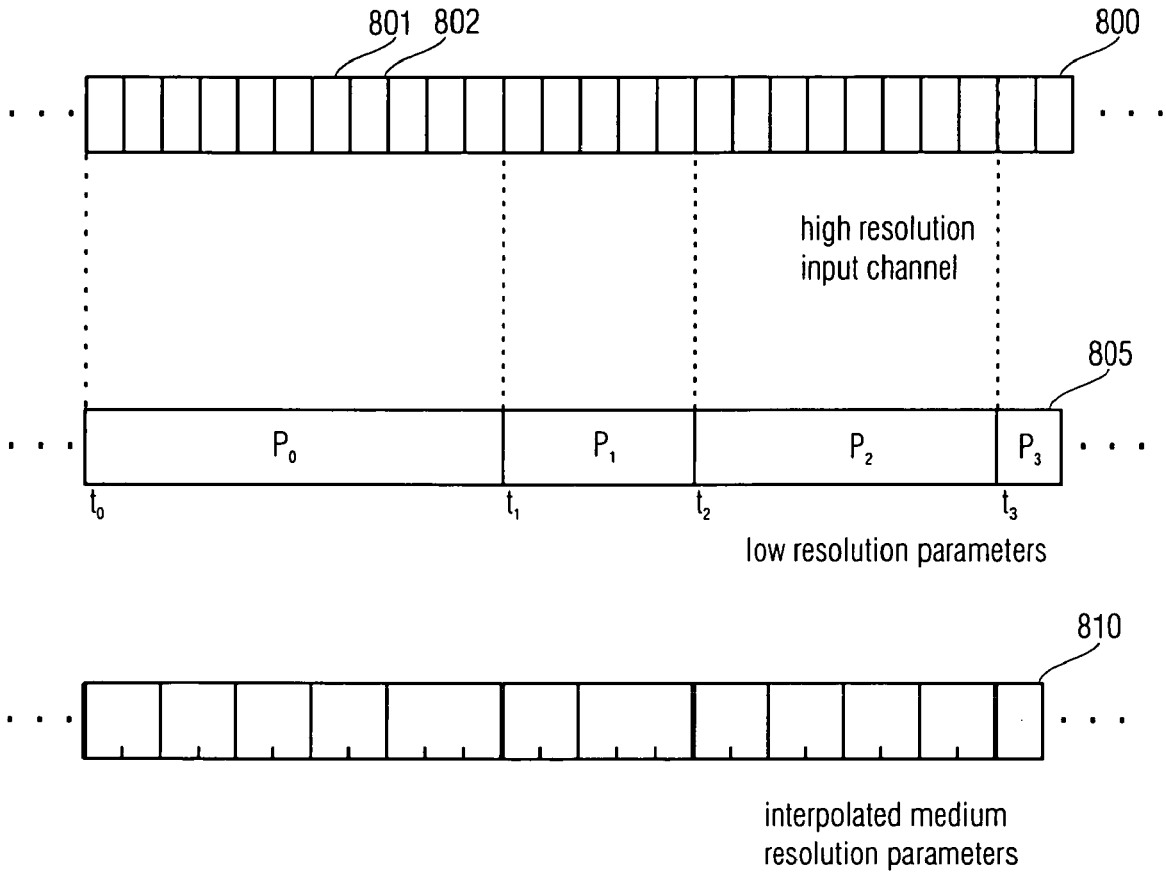
FIG. 8 illustrates a high resolution channel, low resolution parameters and interpolated medium resolution parameters.

FIG. 8 illustrates a general overview over different resolution information. At 800, a high resolution input channel is indicated. The partitions in the input channel 800 can be time-domain sample values 801, 802 or frequency coefficients or subband signals derived from a high resolution channel or even signal frames each frame having a (the same) predetermined number of audio samples. The low resolution parameters are shown at 805 in FIG. 8. Exemplarily, four parameters $P_0$, $P_1$, $P_2$, $P_3$ are indicated. These parameters correspond to time instants $t_0$, $t_1$, $t_2$, $t_3$. In the FIG. 8 embodiment, non-regular time periods between two parameter values are shown. Particularly, the time period between $t_2$ and $t_1$ is smaller than the time period between $t_1$ and $t_0$. When it is assumed, for example, that the time period between $t_1$ and $t_0$ is a frame period matching with a frame grid, then the presence of the time $t_2$ at which there is a parameter change from $P_1$ to $P_2$ implicitly signals that around $t_2$, there is a transient. Thus, the FIG. 8 embodiment corresponds to the previously described embodiment, in which a time border before the transient is triggered: This time border is $t_2$. When the representation at 800 is compared to the representation at 805, it becomes clear that the resolution of the parametric information is lower than the resolution of the input channel. Thus, item 800 and 805 correspond to a situation on an encoder-side, in which a high resolution base channel is transmitted together with low resolution parametric information.

On the decoder-side, the low resolution parametric information at 805 has to be interpolated to obtain an interpolated representation 810. The interpolated representation is shown as a medium resolution interpolation. Naturally, however, dependent on the interpolation algorithm, also a high resolution interpolated parameter representation can be created, which has the same resolution as the high resolution representation 800. It has to be noted here that different resolutions do not necessarily have to be related to sampling values. These situations can also be sequences of frames of sampling values so that items 801 and 802 correspond to different frames. Such a situation will occur, when quite stationary signals are encoded, in which parameters describing inter channel relations have very slowly changing characteristics.

FIG. 5*a* and FIG. 5*b* illustrate a preferred multi-channel decoder. While FIG. 5*a* can be interpreted as an embodiment doing the interpolation in the parameter domain before upmixing, FIG. 5*b* illustrates a situation, in which a low resolution sequence of upmix matrixes or—generally stated—sets of upmixing coefficients is calculated. The interpolation is performed using the upmixing coefficients as parametric information. The latter embodiment is preferable when looking at computation efficiency, since interpolation requires less resources than calculating an upmixing matrix of generally the upmixing parameters. One way of upmixing may include calculating a first upmixing matrix for generating pre-decorrelated signals and a second mixing matrix for mixing signals derived from the decorrelated signals and transmitted or pre-upmixed signals to finally obtain the output channels.

In the FIG. 5*a* embodiment, the transmitted parameters can be regarded as the "parametric information" and the interpolated parameters are the interpolated parametric information, while, in the FIG. 5*b* embodiment, the interpolated upmixing or mixing matrix can be regarded as the interpolated parametric information, and the low resolution sequence of upmixing matrixes can be regarded as the low resolution parametric information.

In the FIG. 5*a* embodiment, the multi-channel decoder includes an upmixer 500 generating N output channels 502 using one or more input channels 504 and interpolated high resolution parametric information provided at line 506. The multi-channel decoder further comprises a parameter interpolator 508 for generating the interpolated high resolution parametric information based on low resolution parametric information provided at line 510. The parameter interpolator 508 is adapted for adaptively using one of a plurality of different interpolation characteristics for interpolating the low resolution parametric information 510 in response to a signal-dependent interpolation characteristic control signal provided at a control signal input 512.

In the FIG. 5*b* embodiment, the high resolution parametric information is the interpolated high resolution upmix matrix output by upmix matrix interpolator 508, the parameter interpolated is device 508, and the interpolated high resolution parametric information is an interpolated upmix matrix or stated in general, a set of interpolated upmixing coefficients generated using one or two adjacent low resolution coefficient sets or matrixes output by upmix matrix calculator 507.

FIG. 5*c* shows an example for an upmixing matrix having upmixing coefficients $\alpha_{11}, \ldots, \alpha_{62}$. These matrix coefficients can be calculated using low resolution parameters, and the coefficients can be interpolated in the "upmix matrix" domain. Reference is made to the functions "f" including parameters $\alpha_{61}$ and $\beta_{62}$. These functions should make clear that the parameters are not only weighting parameters in a linear combination of base channels but can be any control coefficients even themselves including any function of values or other parameters controlling any rule for deriving the output channel using information available at the decoder as long as the parameters depend on the low resolution parameters and can be interpolated in a useful manner.

It is to be emphasized that moving the interpolation from the parameter domain to the matrix domain is advantageous even without implicit or explicit signalling of interpolation characteristics. Also in connection with a straightforward interpolation such as a linear interpolation, the interpolation in the matrix domain, or generally stated in a different domain than the parameter domain itself may be much more computationally efficient. This is especially the case, in which the set of expected different values of a parameter is limited. Such a limitation of the set of allowable (expected) different values occurs when e.g. the parameter has been quantized before being transmitted from the encoder to the decoder. Furthermore, it is assumed that the computational complexity for calculating matrix coefficients from the parameters is computationally more complex than performing interpolation. Then, it is preferable to indirectly calculate the matrix coefficients from the limited set of non-interpolated parameters and to then interpolate in the matrix domain. This "indirect" calculation incurs less computational overhead than the direct calculation such as using a general purpose processor.

Preferred implementations of the "indirect" calculation, i.e., the calculation incurring less overhead than the arithmetic calculation via a processor preferably includes the storage of a lookup table having an entry for a parameter value associated therewith one or more matrix coefficients. Alternatively, the indirect calculation can make use of an application specific processor or any other hardwired processor not suitable for general purpose tasks. All these indirect calculation implementations have in common that their efficiency is heavily related with the number of different possible input values. This number is low when quantized values are used, and this number is high, when interpolated (non-quantized) values are used.

Thus, it is more computationally efficient to do interpolation than to recalculate a lot of matrix values. From a complexity point of view, it is remarkable that the parameter set used to calculate the matrix elements is rather limited due to quantization. This means that all matrix values can preferably be stored in a look-up table, and no calculation of the elements are required. This is advantageous, since calculations for obtaining the matrix elements from the parameter values may include complicated arithmetic functions such as cos(cos ( . . . )) constructions. However, when interpolation in the parameter domain is performed, the look-up tables are not efficient anymore, because the set of parameters is not limited anymore. Naturally, this feature can also be combined with implicit or explicit signalling of interpolation characteristics, but can also be used without different interpolation characteristics, when only e.g. a straightforward linear interpolation or low-pass smoothing is used, which immediately destroys the advantages of having a limited set of values before a very complicated calculation such as the matrix calculation. It is furthermore emphasized that this invention is also useful for other purposes different from the matrix calculation. Generally, when there is a choice between different domains for interpolation, and when a direct calculation of target values based on source values is complicated, and when the source values have a limited set of allowed values, it is preferable to interpolate the target values rather than the source values and to perform an indirect calculation of the non-interpolated target values using the non-interpolated source values using a calculation method which efficiency depends on the number of allowed values, i.e. which is efficient for a small number of allowed values and which is non-efficient (possibly even less efficient than the direct calculation) for a large number of allowed values typically obtained after interpolation.

Figure 6:
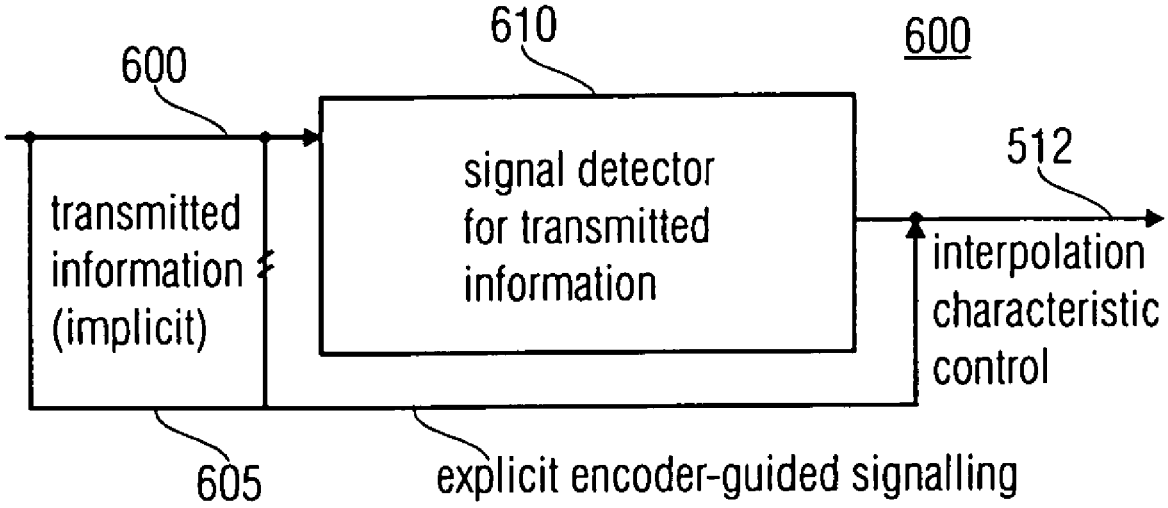
FIG. 6 illustrates preferred embodiments of two different ways for generating the characteristic control.

The control signal 512 is provided by a control signal provider 600 schematically illustrated in FIG. 6. The control signal provider 600 is operative to provide the interpolation characteristic control signal 512 in dependence on the one or more input channels 504 (FIGS. 5*a*, 5*b*), the low resolution parametric information (510) or a signalling information available at the decoder.

Figure 7:
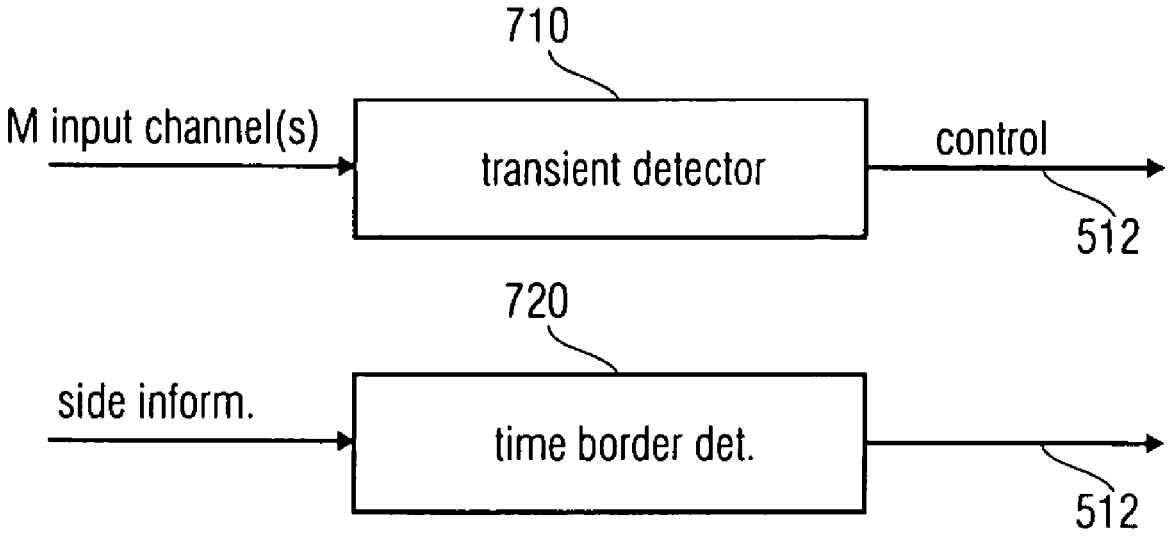
FIG. 7 illustrates preferred embodiments of the signal detector in FIG. 6.

Stated in other words, the interpolation characteristic control signal provided by the control signal provider can be a control signal generated on an encoder-side and transmitted from the encoder-side to the decoder-side as illustrated by line 605 in FIG. 6. This explicit encoder-guided signalling only requires that the control signal provider parses a bit stream received at the decoder to find out the interpolation control information and to output the interpolation characteristic control information at output 512 of the control signal provider shown in FIG. 6. Alternatively or additionally, also an implicit characteristic control information can be used. To this end, the one or more input channels (504 in FIGS. 5*a*, 5*b*) or the parametric information (510 in FIGS. 5*a*, 5*b*) can be used as shown by line 610 in FIG. 6. Thus, the transmitted information includes the input channels 504 or the parametric information 510 of FIGS. 5*a*, 5*b*. The signal on line 600, which is the signal received at the decoder, is input into a specific signal detector 610 for transmitted information. The preferred embodiment of the signal detector for transmitted information is shown in FIG. 7. Preferably, implicit decoder-side interpolation information is derived, when a transient detector 710 detects a transient in the one or more of the M input channels. Alternatively or additionally, the parametric information 510 of FIG. 5*a* or 5*b* can be examined using a time border detector 720 for finding out an irregular time border in the parametric information, which is a very strong hint for an upcoming transient so that a non-transient interpolation characteristic applied by item 508 in FIG. 5*a* or 5*b* is replaced by a transient-style interpolation characteristic so that different interpolated parameters are output at line 506. This results in the situation that the upmixer 500 from FIG. 5*a* or 5*b* forms an upmix, which does not have any or, at least, reduced transient-induced artefacts in the N output channels.

Thus, a decoder having an improved interpolation parameter in accordance with the present invention can be completely decoder-side self-contained. Such a decoder is advantageous in that no additional bits for interpolation control have to be transmitted. Furthermore, such a decoder-side implementation is advantageous in that no bit stream syntax amendments are required. Such a completely decoder-side interpolation control signal generation does not incur signalling overhead and is, therefore, very bit-efficient and flexibly applicable.

Figure 9:
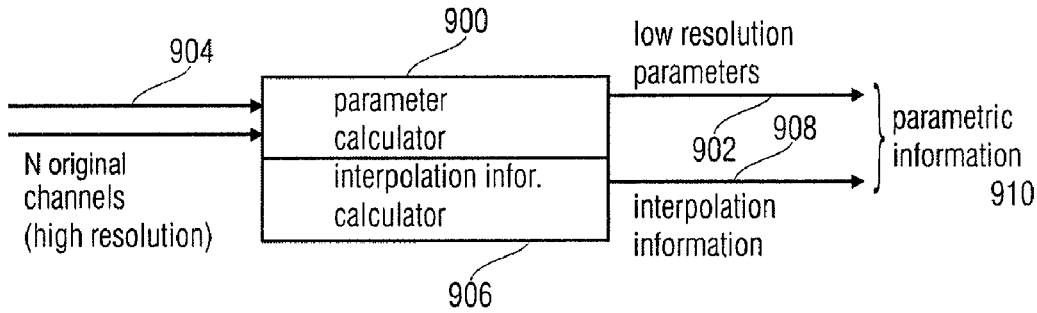
FIG. 9 illustrates a preferred encoder-side embodiment.

Alternatively, encoder-side interpolation control information can be generated and transmitted to a decoder. Such an encoder for generating parametric information derived from an original signal having N input channels, is indicated in FIG. 9. Particularly, the encoder includes a parameter calculator 900 for calculating low resolution parametric information 902 describing one or more relations between two or more input channels 904. Furthermore, the encoder includes an interpolation information calculator 906 for generating high resolution interpolation information 908 based on, at least, two of the N original channels 904. Particularly, the interpolation information calculator 906 is operative to generate the interpolation information such that the interpolation information is usable in a decoder (FIG. 5*a* or 5*b*) for interpolating the low resolution parametric information to obtain a high resolution parametric information. The low resolution parametric information and the interpolation information collectively form the parametric information 910 output by the inventive encoder. Preferably, the inventive encoder furthermore includes a downmixer for downmixing the N original channels into one or two base channels, which are preferably transmitted together with the parametric information 910 to a multi-channel decoder as illustrated in FIG. 5*a* or 5*b*.

Figure 11A:
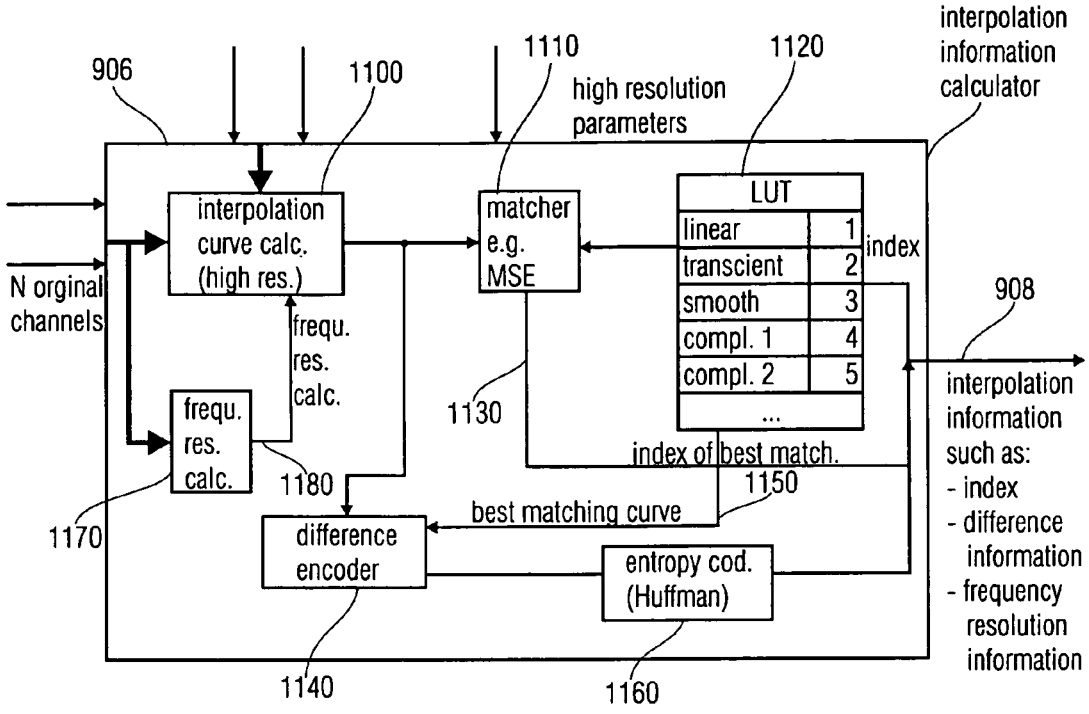
FIG. 11*a* illustrates a preferred embodiment of the encoder-side interpolation information calculator.

Subsequently, FIG. 11*a* is described for illustrating preferred embodiments for generating interpolation information. As shown at 908 in FIG. 11*a*, the interpolation information can be a look-up table index or information derived from a look-up table index, or can be difference information or information derived from the difference information, or can be frequency resolution information or information derived from the frequency resolution information. Particularly, all those interpolation information can be combined to each other or can be separately dependent on the bit stream requirements. When there is a demand for a very low bit number, only a look-up table index might be transmitted from an encoder to a decoder. When, however, some more bits are allowed, frequency resolution information can be transmitted illustrating, which index is designated to which frequency range. When the bit stream allows even more bits, also difference information representing a difference between a signalled interpolation curve or an implicitly found interpolation curve can be added into the output bit stream. However, it is preferred to only include at most so many bits into the bit stream as interpolation information so that the bits required for the low resolution parametric representation and the interpolation information have a bit count, which is smaller than a bit count which would be required for transmitting high resolution parametric information from an encoder to a decoder. Normally, this requirement will not be too hard to fulfil, since in multi-parametric coding techniques such as BCC or parametric stereo, the interpolation information can be included selectively into the bit stream, which means that, for example, only the inter channel intensity differences or inter channel level differences receive interpolation information, while the other parameters such as inter channel coherence, inter channel phase difference, inter channel time difference or inter channel time envelope do not receive any interpolation information or only receive an interpolation characteristic index, while the inter channel level difference or the inter channel intensity difference is coded using an interpolation curve index and, additionally, an encoded difference to the explicitly transmitted or implicitly determined interpolation curve.

The interpolation information calculator 906 preferably receives N original channels and/or high resolution parameters determined by the parameter calculator 900 in FIG. 9. Based on the high resolution parameters and the low resolution parametric representation, the interpolation information calculator is operative to calculate a high resolution interpolation curve using a high resolution interpolation curve calculator 1100. The interpolation curve calculator 1100 outputs a calculated interpolation curve, which is input into an interpolation curve matcher 1110. The interpolation curve matcher 1110 is also connected to a look-up table device 1120. The look-up table device 1120 includes several interpolation curve entries such as a linear interpolation curve, a transient interpolation curve, a smooth interpolation curve (such as a cubic spline interpolation), a complex interpolation curve, an additional complex interpolation curve, etc. Each of the interpolation curves is accessible via an index, which is, in the FIG. 11*a* embodiment, an index between 1 and 5. When the look-up table 1120 only includes four different interpolation curves, a two-bit index is sufficient. When, however, the look-up table 1120 includes up to eight different interpolation curves, a three-bit index will be required. The matcher 1110 is operative to compare the actual interpolation curve calculated by device 1100 to each of the interpolation curves in the look-up table 1120. Based on a mean square error determination or any other matching algorithm, the matcher outputs an index 1130 of the best-matching interpolation curve. This index is preferably output as interpolation information at line 908.

In alternative embodiments, the interpolation information calculator 906 as shown in FIG. 11*a* furthermore includes a difference encoder 1140, which is operative to calculate a difference between the actual interpolation curve output by device 1100 and the best-matching curve on line 1150. The difference between the best-matching curve and the actual curve is preferably entropy-encoded in an entropy coder 1160. This coder is preferably a Huffman encoder. The Huffman code words are also fed to the output line 908 as the difference information, which preferably form a part of the interpolation information. Additionally, the interpolation information calculator 906 includes a frequency resolution calculator 1170 for calculating a frequency resolution of an interpolation curve. Stated in other words, the frequency resolution calculator determines, whether a single interpolation curve for all frequency bands is sufficient or not. In a transient situation, i.e., a hard attack in the signal, it is assumed that all frequency components exist at the attack with more or less identical amplitudes. Therefore, a very low frequency resolution for the interpolation information will be sufficient, since, with respect to frequency, the transient is the same for all frequencies.

In a more general case, different interpolation characteristics for different frequency bands can be calculated and transmitted as determined by the frequency resolution calculator 1170. Thus, the frequency resolution calculator 1170 is operative to input a frequency resolution control signal 1180 into the interpolation curve calculator 1100 so that the interpolation curve calculator 1100 is operative to perform the same operation for different frequency bands so that different interpolation indices and different difference information for the several frequency bands are calculated and transmitted to a decoder. This embodiment is not limited to have tonal, non-transient signals. Indeed, it may be beneficial to have at least a plurality (just a few, e.g. between 2 and 8) bands even for transient signals. Thus, this embodiment is not limited to just one band for transients.

Figure 11B:
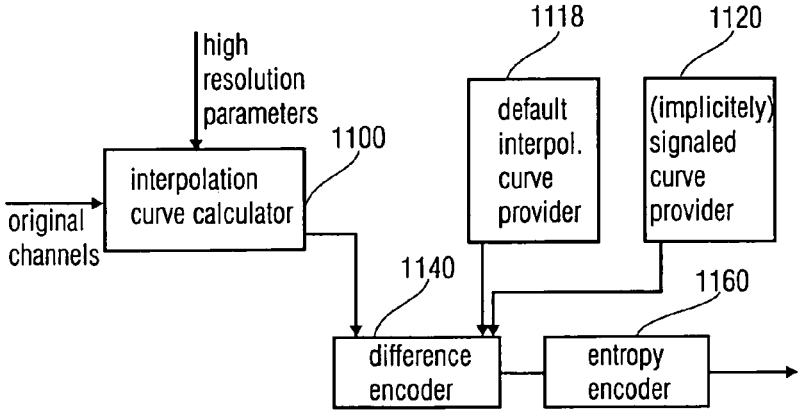
FIG. 11*b* illustrates a further preferred embodiment and a specific detail of the FIG. 11*a* encoder-side interpolation information calculator.

The encoder of FIG. 11*b* can in a further embodiment be designed to operate (FIG. 16*a*) the difference encoder 1140, to calculate a difference between the actual interpolation curve output by device 1100 and a default interpolation curve (output by schematic device 1118). This default interpolation curve could be a linear interpolation from one value to the next. The difference between the default interpolation curve and the actual curve is preferably entropy-encoded in an entropy coder 1160.

Even further, as shown in FIG. 11*b*, the difference encoder 1140 can be made (FIG. 16*b*) to calculate a difference between the actual interpolation curve output by device 1100 and the interpolation curve (output by schematic device 1120) implicitly signalled to the decoder, by means of e.g. a transient position. This is in line with FIG. 2*a* where the transient position 205 is signalled in the bitstream, and the decoder based on that calculates the interpolation curve 209 based on position 201 and 203. The similar calculation is done by the encoder in order to be able to calculate the difference curve 207. This difference curve is preferably entropy-encoded in an entropy coder 1160. The encoder of FIG. 11 can further be made to normalise the difference signal with respect to the interpolation signal it is calculated from e.g. by dividing the difference signal by a factor derived from the interpolation signal such as a power measure, an arithmetic mean, a geometric mean etc.

Figure 16A:
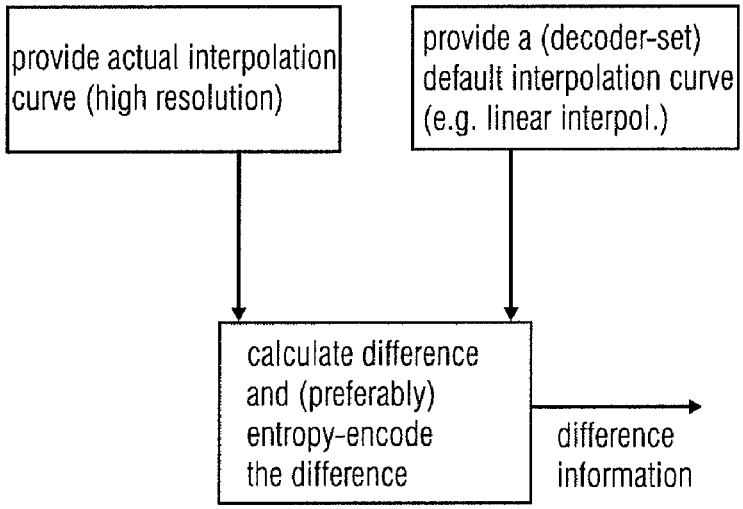
FIG. 16*a* a preferred mode of operation of the FIG. 11*b* embodiment.
Figure 16B:
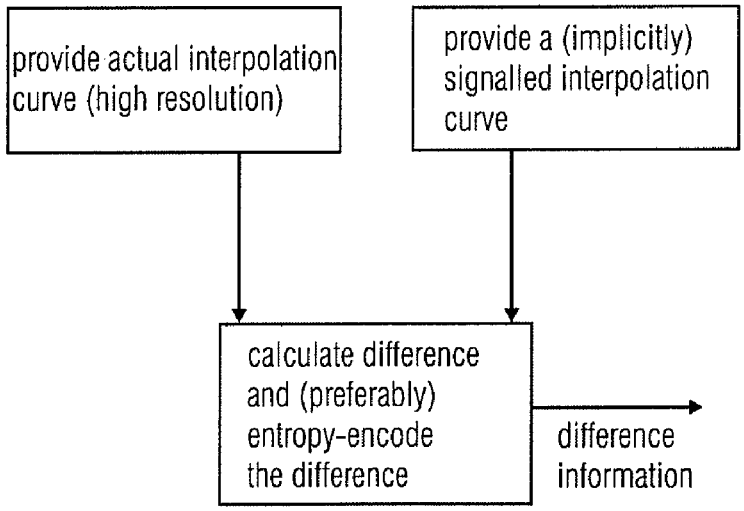
FIG. 16*b* a further preferred mode of operation of the FIG. 11*b* embodiment.

The use of these implicitly signalled interpolation curve or a general default interpolation curve is shown in FIG. 11 *b* and FIGS. 16*a* and 16*b*. Where typically the decoder gets transient position information or any other information on the current framing, and from this, based on a rule or a set of (simple) rules, look-up table or function decides on interpolation. The effect of such a decoder is outlined in FIG. 1. And the effect of such a decoder together with the difference coding is outlined in FIG. 2

Figure 10:
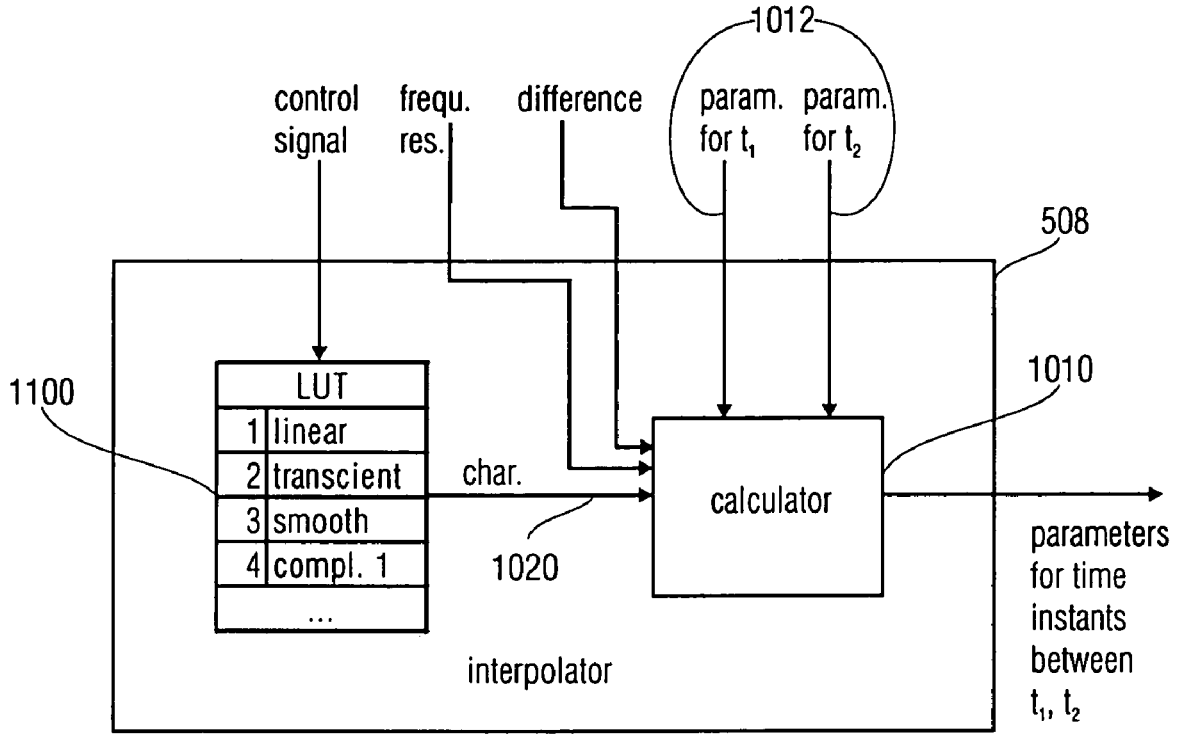
FIG. 10 illustrates a preferred embodiment of the decoder-side interpolator.

FIG. 10 illustrates a decoder-side implementation of the interpolator 508 of FIG. 5*a* or 5*b*. The interpolator 508 as shown in FIG. 10 includes a look-up table 1000 and a calculator core 1010, which performs the calculation of the high resolution parameters for time points between two time instants, for which parameters input at lines 1012 were given. The look-up table 1000 receives the control signal 512 as shown in FIG. 5*a* or 5*b* and as generated using the embodiments shown in FIG. 6 or FIG. 7. When the FIG. 10 embodiment only receives the control signal 512 including a look-up table index, a certain selected interpolation characteristic 1020 is input into the calculator 1010 so that the calculator calculates interpolated values for a parameter between time $t_1$ and $t_2$. When the calculator also receives a frequency resolution information, the calculator 1010 will be effective to not only generate a single high resolution parameter for all frequencies, but will be operative to perform and enhance the interpolation of frequency-dependent parameters included in the low resolution parametric representation for several time instants $t_1$, $t_2$ . . . .

Alternatively or additionally, the calculator 1010 also receives a (decoded) difference information so that the calculator 1010 can calculate a very improved representation of the interpolated parameters using the explicitly or implicitly determined interpolation characteristic 1020 and the difference information.

Subsequently, the inventive feature of using symmetries in multi-channel tree structures will be discussed in more detail referring to FIG. 12 and FIG. 13. It has to be pointed out here that, in accordance with the present invention, this feature as described in connection with FIG. 4 and the FIGS. 12 and 13 can be used together with the interpolation features of the present invention. However, the inventive parameter coding feature can also be used without the interpolation feature, when, for example, an encoder transmits high resolution parametric representation, or, when a decoder has generated a high resolution parametric representation by interpolation or by any other means.

Figure 12:
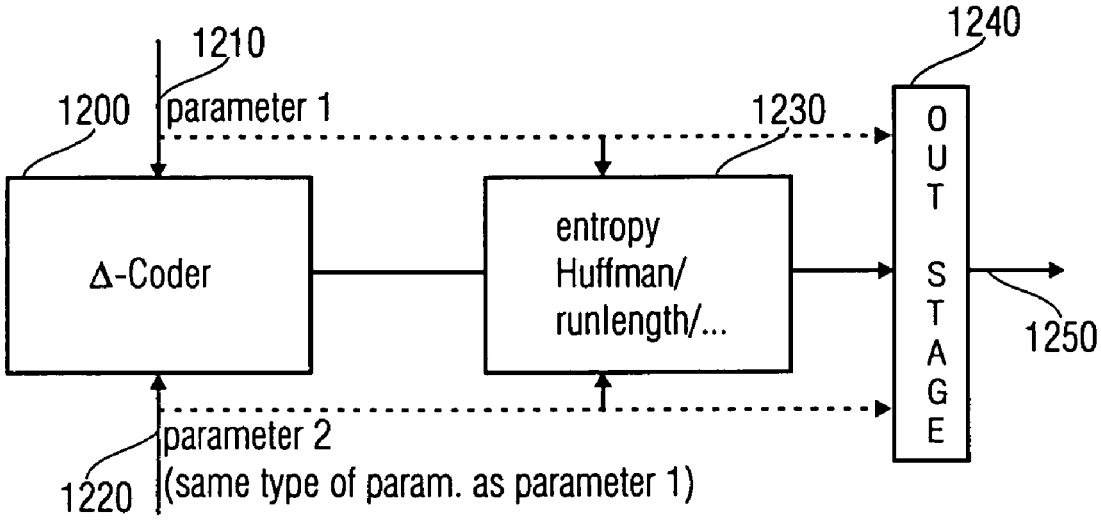
FIG. 12 illustrates a preferred embodiment of an inter-parameter delta-coder.

As shown in FIG. 12, an inventive encoder of FIG. 9 can include, within the parameter calculator 900, a delta or a difference coder 1200, which is operative to receive a first parameter 1210 and a second parameter 1220. In accordance with this invention, the first parameter 1 and the second parameter 2 are preferably parameters of the same kind of parameters. This means that both parameters are inter channel intensity difference parameters or inter channel level difference parameters or inter channel time difference parameters or inter channel phase difference parameters or inter channel time envelope parameters or any other parameters describing any relation between two channels or a channel and a virtual channel. The delta coder 1200 is operative to calculate a difference between two parameters of the same kind of parameter and to subsequently forward this difference into a parameter entropy coder 1230, which can include a Huffman encoder, a run-length encoder or a combined coder. The output of the entropy coder 1230 and the first or the second parameter are input into an output stage 1240 to generate an output signal 1250. The output signal will include the first or the second parameter optionally in encoded form and, additionally, a parameter difference in encoded form. Furthermore, the output signal can also include selected information indicating, whether the first parameter or the second parameter will be included in a non-difference form.

Furthermore, the FIG. 12 device can include a comparator for comparing a difference value to the original value of the first or the second parameter to determine, whether transmitting the difference of the parameters will result in a coding advantage. When it comes out that the difference is larger than the original parameter, then a select information can be signalled and the parameter itself instead of the difference is transmitted. Thus, a simulcast transmission instead of difference transmission is selected in the case, in which the difference encoding does not result in an improved coding efficiency. Furthermore, it can be useful to switch between parameter 1 and parameter 2 as the parameter, which is transmitted in absolute form rather than in difference form. As in the simulcast embodiment, the inventive encoder will determine based on bit efficiency reasons, whether it is better to transmit the first parameter or the second parameter in absolute rather than difference form. Furthermore, the present invention can be combined with difference encoding in time or frequency to further improve the coding efficiency. In this context, it is to be noted that, especially when Huffman encoding is used, the coding efficiency automatically increases, when the value range of the transmitted values decreases. This is due to the fact that, as it is known in the art, a short code word is allocated to an information word, which occurs more often in a set of information words than an information word having associated therewith a longer code word. When the FIG. 4B case is considered, there can often be the case that the coherence and even the level difference between left front and left surround on the one-hand side and right front and right surround on the other hand are (almost) equal, so that the difference encoding will result (with or without quantization using a certain quantizer) in zero values, which can very well be encoded using a run-length code, when there is a run of several zeros for these parameters.

Figure 13:
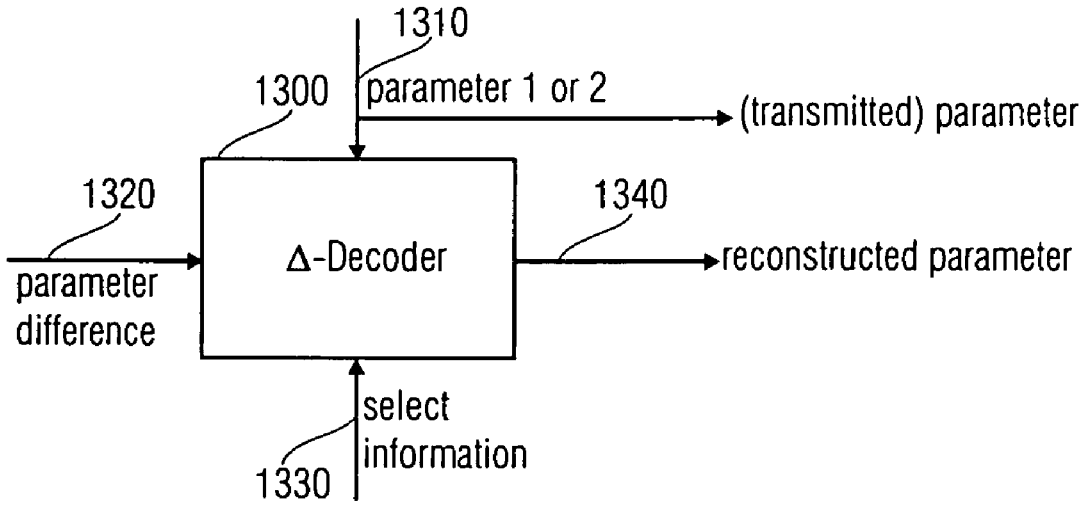
FIG. 13 illustrates a preferred embodiment of the decoder-side inter-parameter delta-decoder.

FIG. 13 illustrates a decoder-side for the FIG. 12 encoder-side embodiment. The FIG. 5*a* or 5*b* decoder includes, in addition to the elements shown in FIG. 5*a* or 5*b*, the delta decoder 1300, receiving the transmitted parameter 1310 and the parameter difference 1320 from the bit stream or from corresponding decoders not shown in FIG. 13 or FIG. 5*a* or 5*b*. Furthermore, the delta decoder 1300 receives select information 1330 so that the delta decoder 1300 is in a position to calculate the reconstructed parameter 1340 so that the reconstructed parameter 1340 and the transmitted parameter 1310 can be input into the interpolator 508 of FIG. 5*a* or 5*b* as the parametric information 510. As already noted in connection with FIG. 12, the transmitted parameter 1310 and the reconstructed parameter 1340 can be fed into the upmixer 500 directly, since the inter-parameter difference coding feature can be applied in multi-channel decoding independent on the interpolation feature illustrated by interpolator 508 of FIG. 5*a* or 5*b*.

Figure 14:
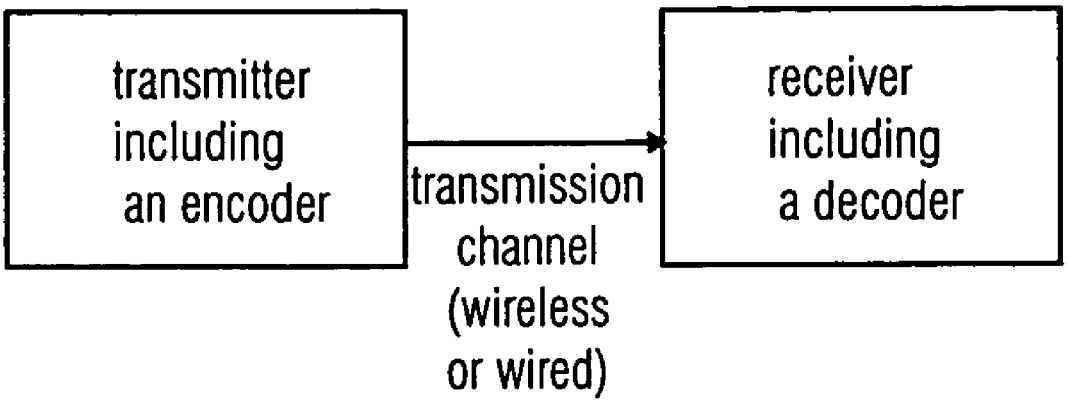
FIG. 14 a transmitter and a receiver of a transmission system.
Figure 15:
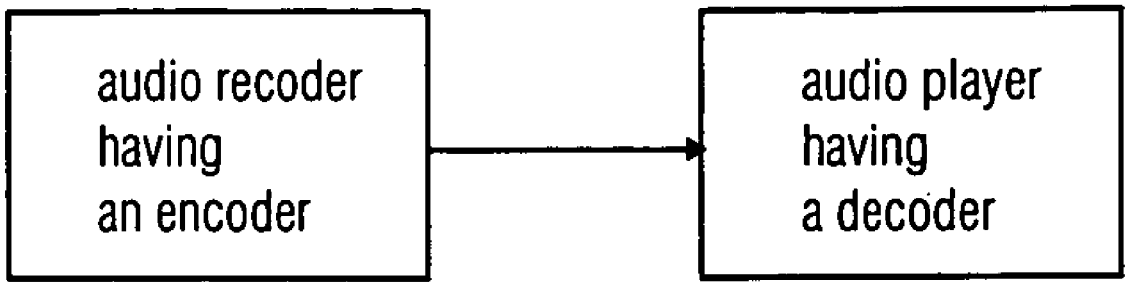
FIG. 15 an audio recorder having an inventive encoder and an audio player having a decoder.

The inventive methods or devices or computer programs can be implemented or included in several devices. FIG. 14 shows a transmission system having a transmitter including an inventive encoder and having a receiver including an inventive decoder. The transmission channel can be a wireless or wired channel. Furthermore, as shown in FIG. 15, the encoder can be included in an audio recorder or the decoder can be included in an audio player. Audio records from the audio recorder can be distributed to the audio player via the Internet or via a storage medium distributed using mail or courier resources or other possibilities for distributing storage media such as memory cards, CDs or DVDs.

Depending on certain implementation requirements of the inventive methods, the inventive methods can be implemented in hardware. The implementation can be performed using a digital storage medium, in particular a disk or a CD having electronically readable control signals stored thereon, which can cooperate with a programmable computer system such that the inventive methods are performed.

While the foregoing has been particularly shown and described with reference to particular embodiments thereof, it will be understood by those skilled in the art that various other changes in the form and details may be made without departing from the spirit and scope thereof. It is to be understood that various changes may be made in adapting to different embodiments without departing from the broader concepts disclosed herein and comprehended by the claims that follow.

What is claimed is:

1. A decoder comprising:

an upmixer implemented for generating N output channels using one or more input channels and interpolated high resolution parametric information;

a residual signal provider implemented for providing an interpolation residual signal representing a difference between a high resolution interpolation characteristic and a predetermined interpolation characteristic; and a parameter interpolator implemented for generating the interpolated high resolution parametric information, wherein the parameter interpolator is implemented for combining low resolution parametric information, a predetermined interpolation characteristic and the interpolation residual signal to obtain the high resolution parametric information, wherein the predetermined interpolation characteristic is explicitly or implicitly determined; and wherein the decoder comprises a hardware apparatus.

2. The decoder in accordance with claim 1, in which the low resolution parametric information has a low time resolution, in which the one or more input channels and the N output channels have a higher time resolution, and in which the high resolution parametric information has a time resolution higher than the low time resolution and lower or equal to the time resolution of the channels.

3. The decoder in accordance with claim 1, in which the parameter interpolator is implemented for performing a transient interpolation characteristic or a non-transient interpolation characteristic as two interpolation characteristics of the plurality of different interpolation characteristics.

4. The decoder in accordance with claim 3, in which the transient interpolation characteristic has a first portion introducing no or only a small change in a to be interpolated parameter, and a second portion introducing a higher change in a to be interpolated parameter, the second portion being more close to or coincident with a transient time instant than the first time portion.

5. The decoder in accordance with claim 3, in which a control signal provider is implemented for providing a transient control signal for indicating a transient, and in which the parameter interpolator is implemented, for switching to the transient interpolation characteristic, when a control signal indicates a transient, wherein the control signal is provided by a control signal provider, wherein the control signal depends on the one or more input channels, the low resolution parametric information or signaling information available at the decoder.

6. The decoder in accordance with claim 1, further comprising a control signal provider for providing a control signal, wherein the control signal depends on one or more input channels, the low resolution parametric information or signaling information available at the decoder;

wherein the control signal provider is implemented for detecting a parametric information not fitting into a predetermined regular parameter grid, and in which the control signal provider is implemented to indicate a positive detection in the control signal to cause an interpolation characteristic switch in the parameter interpolator.

7. The decoder in accordance with claim 1, further comprising a control signal provider for providing a control signal, wherein the control signal depends on the one or more input channels, the low resolution parametric information or signaling information available at the decoder, wherein the parameter interpolator includes a look-up table having stored a plurality of different interpolation characteristics accessible via a table index, and wherein the control signal provider is implemented to retrieve an index from information transmitted to the decoder and to provide the index to the parameter interpolator.

8. The decoder in accordance with claim 1, in which different low resolution parametric information is provided for different frequency bands, and in which the parameter interpolator is implemented to apply a signal interpolation characteristic to more than one frequency band.

9. The decoder in accordance with claim 8, further comprising a control signal provider for providing a control signal, wherein the control signal depends on the one or more input channels, the low resolution parametric information or signaling information available at the decoder, wherein the control signal provider is implemented to provide the control signal such that the control signal has frequency information indicating a frequency band of parametric information which is to be interpolated using a certain interpolation characteristic among different interpolation characteristics for different frequency bands.

10. The decoder in accordance with claim 1, in which the upmixer is implemented to provide a first pair of channels using a first parameter and a second pair of channels using a second parameter, the decoder having a parameter reconstructor for receiving a parameter and a parameter difference, the parameter reconstructor being implemented to combine the parameter and the parameter difference to obtain the first parameter or the second parameter.

11. The decoder in accordance with claim 10, in which the first parameter and the second parameter are from the same kind of parameters, wherein the kind of parameter includes inter channel level difference parameters, inter channel intensity difference parameters, inter channel coherence parameters, inter channel time difference parameters, inter channel phase difference parameters, and inter channel time envelope parameters.

12. The decoder in accordance with claim 10, in which the first pair of channels includes a left channel and a right channel, in which the second pair of channels includes a left-surround channel and a right-surround channel, or in which the first pair of channels includes a left channel and a left-surround channel, and the second pair of channels includes a right channel and a right-surround channel, or in which the first pair of channels includes a combined left channel and a combined right channel, and in which the second pair of channels includes a center channel and a low-frequency enhancement channel.

13. The decoder in accordance with claim 1, in which the upmixer is implemented to perform an upmix of the one or more input channels using upmixing coefficients as the interpolated high resolution parametric information, and in which the parameter interpolator is implemented to interpolate between low resolution upmixing coefficients calculated using low resolution parametric information included in an input signal to the decoder, or in which the parameter interpolator is implemented to interpolate between low resolution parametric information included in the input signal to obtain high resolution parametric information and to calculate high resolution upmixing coefficients based on the high resolution parametric information.

14. A decoder in accordance with claim 1, wherein the parameter interpolator is implemented for generating the interpolated high resolution parametric information based on the low resolution parametric information, wherein the parameter interpolator is implemented to adaptively use one of a plurality of different interpolation characteristics for interpolating the low resolution parametric information in response to a control signal; and wherein the decoder further comprises a control signal provider for providing the control signal, wherein the control signal depends on the one or more input channels, the low resolution parametric information or signaling information available at the decoder.

15. An encoder for generating a parametric information derived from an original signal having N input channels, comprising:

a parameter calculator implemented for calculating low resolution parametric information describing one or more relations between two or more of the N input channels; and an interpolation information calculator implemented for generating high resolution interpolation information based on at least two of the N input channels, wherein the interpolation information calculator is implemented to calculate, as interpolation information, an interpolation residual signal representing a difference between a high resolution interpolation characteristic and an interpolation characteristic, the interpolation characteristic being pre-determined or being signalled or implicitly found; and an output for outputting the interpolation residual signal, wherein the encoder comprises a hardware apparatus.

16. The encoder in accordance with claim 15, in which the interpolation information calculator is operative:

to calculate a high resolution parametric information;

to match the high resolution parametric information with a plurality of predetermined interpolation curves in order to find out the best-matching interpolation curve; and to signal an indication of the best-matching curve as the interpolation information.

17. The encoder in accordance with claim 15, in which the interpolation information calculator is operative:

to calculate a high resolution parametric information;

to match the high resolution parametric information with a plurality of predetermined interpolation curves in order to find out the best-matching interpolation curve;

to calculate a difference of the best-matching curve and the high resolution parametric information; and to encode the difference and to include the encoded difference into the high resolution interpolation information.

18. The encoder in accordance with claim 15, in which the interpolation information calculator is implemented to estimate and signal a frequency range of a transmitted base channel, to which the interpolation information is to be applied.

19. The encoder in accordance with claim 15, in which the interpolation information calculator is implemented to generate a single interpolation curve information related to all frequency bands of a block of base channel samples, the block of base channel samples being determined by time instants determined by two subsequent parameter values of the low resolution parametric information.

20. The encoder in accordance with claim 15, in which the interpolation information calculator includes a look-up table having several different interpolation characteristics, and in which an interpolation information calculator is implemented to use an index into the look-up table for generating the interpolation information.

21. The encoder in accordance with claim 15, in which the parameter calculator is implemented to calculate a first parameter from a first pair of channels, to calculate a second parameter from a second pair of channels, and to calculate a parameter difference between the first and the second parameter; and to include information on the parameter difference and the first or the second parameter into the low resolution parametric representation.

22. A decoding method comprising:

generating N output channels using one or more input channels and interpolated high resolution parametric information;

providing an interpolation residual signal representing a difference between a high resolution interpolation characteristic and a predetermined interpolation characteristic;

generating the interpolated high resolution parametric information by combining low resolution parametric information, a predetermined interpolation characteristic and the interpolation residual signal to obtain the high resolution parametric information, wherein the predetermined interpolation characteristic is explicitly or implicitly determined, and wherein the method is performed by a hardware apparatus.

23. A method of generating a parametric information derived from an original signal having N input channels, comprising:

calculating low resolution parametric information describing one or more relations between two or more of the N input channels; and generating high resolution interpolation information based on at least two of the N input channels, wherein the generating includes calculating, as interpolation information, an interpolation residual signal representing a difference between a high resolution interpolation characteristic and an interpolation characteristic, the interpolation characteristic being pre-determined or being signalled or implicitly found; and outputting the interpolation residual signal, wherein the method of generating is performed by a hardware apparatus.

24. A transmitter or audio recorder having an encoder for generating a Parametric information derived from an original signal having N input channels, the encoder comprising:

a parameter calculator implemented for calculating low resolution parametric information describing one or more relations between two or more of the N input channels; and an interpolation information calculator implemented for generating high resolution interpolation information based on at least two of the N input channels, wherein the interpolation information calculator is implemented to calculate, as interpolation information, an interpolation residual signal representing a difference between a high resolution interpolation characteristic and an interpolation characteristic, the interpolation characteristic being pre-determined or being signalled or implicitly found; and an output for outputting the interpolation residual signal, wherein the transmitter comprises a hardware apparatus.

25. A receiver or audio player having a decoder comprising:

an upmixer implemented for generating N output channels using one or more input channels and interpolated high resolution parametric information;

a residual signal provider implemented for providing an interpolation residual signal representing a difference between a high resolution interpolation characteristic and a predetermined interpolation characteristic; and a parameter interpolator implemented for generating the interpolated high resolution parametric information, wherein the parameter interpolator is implemented for combining low resolution parametric information, a predetermined interpolation characteristic and the interpolation residual signal to obtain the high resolution parametric information, wherein the predetermined interpolation characteristic is explicitly or implicitly determined, wherein the upmixer, the residual signal provider or the parameter interpolator comprises a hardware implementataion.

26. A transmission system having a transmitter or audio recorder having an encoder for generating a parametric information derived from an original signal having N input channels, the encoder comprising:

a parameter calculator implemented for calculating low resolution parametric information describing one or more relations between two or more of the N input channels; and an interpolation information calculator implemented for generating high resolution interpolation information based on at least two of the N input channels, wherein the interpolation information calculator is implemented to calculate, as interpolation information, an interpolation residual signal representing a difference between a high resolution interpolation characteristic and an interpolation characteristic, the interpolation characteristic being pre-determined or being signalled or implicitly found; and an output for outputting the interpolation residual signal; and a receiver or audio player having a decoder comprising:

an upmixer implemented for generating N output channels using one or more input channels and interpolated high resolution parametric information;

a residual signal provider implemented for providing an interpolation residual signal representing a difference between a high resolution interpolation characteristic and a predetermined interpolation characteristic; and a parameter interpolator implemented for generating the interpolated high resolution parametric information, wherein the parameter interpolator is implemented for combining low resolution parametric information, a predetermined interpolation characteristic and the interpolation residual signal to obtain the high resolution parametric information, wherein the predetermined interpolation characteristic is explicitly or implicitly determined, wherein the parameter calculator, the interpolation information calculator or the output comprises a hardware implementation, or wherein the upmixer, the residual signal provider or the parameter interpolator comprises a hardware implementatation.

27. A method of transmitting or audio recording, the method having a method of generating a parametric information derived from an original signal having N input channels, comprising:

calculating low resolution parametric information describing one or more relations between two or more of the N input channels; and generating high resolution interpolation information based on at least two of the N input channels, wherein the generating includes calculating, as interpolation information, an interpolation residual signal representing a difference between a high resolution interpolation characteristic and an interpolation characteristic, the interpolation characteristic being pre-determined or being signalled or implicitly found; and outputting the interpolation residual signal, wherein the method is performed by a hardware apparatus.

28. A method of receiving or audio playing, the method including a method of decoding comprising:

generating N output channels using one or more input channels and interpolated high resolution parametric information;

providing an interpolation residual signal representing a difference between a high resolution interpolation characteristic and a predetermined interpolation characteristic;

generating the interpolated high resolution parametric information by combining low resolution parametric information, a predetermined interpolation characteristic and the interpolation residual signal to obtain the high resolution parametric information, wherein the predetermined interpolation characteristic is explicitly or implicitly determined, wherein the method is performed by a hardware apparatus.

29. A method of receiving or audio playing, the method including a method of decoding comprising:

generating N output channels using one or more input channels and interpolated high resolution parametric information;

providing an interpolation residual signal representing a difference between a high resolution interpolation characteristic and a predetermined interpolation characteristic;

generating the interpolated high resolution parametric information by combining low resolution parametric information, a predetermined interpolation characteristic and the interpolation residual signal to obtain the high resolution parametric information, wherein the predetermined interpolation characteristic is explicitly or implicitly determined; and transmitting or audio recording, the method having a method of generating a parametric information derived from an original signal having N input channels, comprising:

calculating low resolution parametric information describing one or more relations between two or more of the N input channels; and generating high resolution interpolation information based on at least two of the N input channels, wherein the generating includes calculating, as interpolation information, an interpolation residual signal representing a difference between a high resolution interpolation characteristic and an interpolation characteristic, the interpolation characteristic being pre-determined or being signalled or implicitly found; and outputting the interpolation residual signal, wherein the method of generating is performed by a hardware apparatus.

30. A non-transitory digital storage medium having stored thereon a computer program for performing, when running on a computer, a decoding method comprising:

generating N output channels using one or more input channels and interpolated high resolution parametric information;

providing an interpolation residual signal representing a difference between a high resolution interpolation characteristic and a predetermined interpolation characteristic;

generating the interpolated high resolution parametric information by combining low resolution parametric information, a predetermined interpolation characteristic and the interpolation residual signal to obtain the high resolution parametric information, wherein the predetermined interpolation characteristic is explicitly or implicitly determined.

31. A non-transitory digital storage medium having stored thereon a computer program for performing, when running on a computer, a method of generating a parametric information derived from an original signal having N input channels, comprising:

calculating low resolution parametric information describing one or more relations between two or more of the N input channels; and generating high resolution interpolation information based on at least two of the N input channels, wherein the generating includes calculating, as interpolation information, an interpolation residual signal representing a difference between a high resolution interpolation characteristic and an interpolation characteristic, the interpolation characteristic being pre-determined or being signalled or implicitly found; and outputting the interpolation residual signal,.

* * * * *